United States Patent [19]

Hasegawa et al.

[11] Patent Number: 4,834,814

[45] Date of Patent: May 30, 1989

[54] METALLIC GLASSES HAVING A COMBINATION OF HIGH PERMEABILITY, LOW COERCIVITY, LOW AC CORE LOSS, LOW EXCITING POWER AND HIGH THERMAL STABILITY

[75] Inventors: Ryusuke Hasegawa, Morristown; Gordon E. Fish, Lake Hiawatha, both of N.J.

[73] Assignee: Allied-Signal Inc., Morris Township, Morris County, N.J.

[21] Appl. No.: 168,524

[22] Filed: Mar. 7, 1988

Related U.S. Application Data

[63] Continuation of Ser. No. 002,068, Jan. 12, 1987, abandoned, which is a continuation of Ser. No. 718,207, Apr. 3, 1985, abandoned, which is a continuation of Ser. No. 497,391, May 23, 1983, abandoned.

[51] Int. Cl.[4] ..... H01F 1/04

[52] U.S. Cl. ..... 148/304; 420/106; 420/117; 420/121

[58] Field of Search ..... 148/31.55; 75/123 L, 75/123 B, 123 H, 123 J, 123 M, 126 A, 126 C, 126 D, 126 E, 126 F, 126 Q

[56] References Cited

U.S. PATENT DOCUMENTS

| | | | |
|---|---|---|---|
| Re. 29,989 | 5/1979 | Polk et al. | 148/403 |
| 3,856,513 | 12/1974 | Chen et al. | 75/123 B |
| 4,067,732 | 1/1978 | Ray | 148/403 |
| 4,217,135 | 8/1980 | Luborsky et al. | 75/123 L |
| 4,219,355 | 8/1980 | De Cristofaro et al. | 75/123 B |
| 4,225,339 | 9/1980 | Inomata et al. | 75/123 B |
| 4,236,946 | 12/1980 | Aboaf et al. | 148/31.55 |
| 4,298,409 | 11/1981 | De Cristofaro et al. | 148/31.55 |
| 4,300,950 | 11/1981 | Luborsky et al. | 75/123 B |
| 4,409,041 | 11/1983 | Datta et al. | 148/31.55 |
| 4,437,907 | 3/1984 | Sato et al. | 148/31.55 |
| 4,462,826 | 7/1984 | Inomata et al. | 148/31.55 |
| 4,473,413 | 9/1984 | Nathsingh et al. | 148/31.5 |

OTHER PUBLICATIONS den Broeder et al., "Magnetization Reversalin $Fe_{80}B_{1.5}Si_5$ Metallic Glass with Large Uniaxial Magnetostrictive Anisotropy," J App. Phys. 50(11), Nov. 1979, pp. 7116–7121.

*Primary Examiner*—John P. Sheehan
*Attorney, Agent, or Firm*—Gus T. Hampilos

[57] ABSTRACT

Metallic glasses having high permeability, low magnetostriction, low coercivity, low ac core loss, low exciting power and high thermal stability are disclosed. The metallic glasses consist essentially of a composition defined by the formula $Fe_aM_bB_cSi_dC_e$ in which "a"–"e" are in atom percent, the sum ("a"+"b"+"c"+"d"+"e") equals 100, M is at least one element selected from the group consisting of Mo, Cr, Ti, Zr, Hf, Nb, Ta, V and W, "a" ranges from about 66 to 81.5, "b" ranges from about 0.5 to 6, "c" ranges from about 10 to 26, "d" ranges from about 1 to 12, "e" ranges from about 0 to 2 and the sum ("c"+"d"+"e") ranges from about 18 to 28, and have been annealed at a temperature, $T_a$, for a time, $t_a$, sufficient to induce precipitation of discrete particles therein. Such metallic glasses are suitable for use in tape recorder heads, relay cores, transformers and the like.

12 Claims, No Drawings

METALLIC GLASSES HAVING A COMBINATION OF HIGH PERMEABILITY, LOW COERCIVITY, LOW AC CORE LOSS, LOW EXCITING POWER AND HIGH THERMAL STABILITY

This application is a continuation of application Ser. No. 07/002,068, filed Jan. 12, 1987, now abandoned which, in turn, is a continuation of application Ser. No. 06/718,207, filed Apr. 3, 1985, now abandoned which, in turn, is a continuation of application Ser. No. 06/497,391, filed May 23, 1983, now abandoned.

BACKGROUND OF THE INVENTION

1. Field of the Invention

The invention relates to metallic glasses having high permeability, low magnetostriction, low coercivity, low ac core loss, low exciting power and high thermal stability.

2. Description of the Prior Art

As is known, metallic glasses are metastable materials lacking any long range order. X-ray diffraction scans of glassy metal alloys show only a diffuse halo similar to that observed for inorganic oxide glasses.

Metallic glasses (amorphous metal alloys) have been disclosed in U.S. Pat. No. 3,856,513, issued Dec. 24, 1974 to H. S. Chen et al. These alloys include compositions having the formula $M_aY_bZ_c$, where M is a metal selected from the group consisting of iron, nickel, cobalt, vanadium and chromium, Y is an element selected from the group consisting of phosphorus, boron and carbon and Z is an element selected from the group consisting of aluminum, silicon, tin, germanium, indium, antimony and beryllium, "a" ranges from about 60 to 90 atom percent, "b" ranges from about 10 to 30 atom percent and "c" ranges from about 0.1 to 15 atom percent. Also disclosed are metallic glassy wires having the formula $T_iX_j$, where T is an element selected from the group consisting of phosphorus, boron, carbon, aluminum, silicon, tin, germanium, indium, beryllium and antimony, "i" ranges from about 70 to 87 atom percent "j" ranges from about 13 to 30 atom percent. Such materials are conveniently prepared by rapid quenching from the melt using processing techniques that are now well-known in the art.

Metallic glasses are also disclosed in U.S. Pat. No. 4,067,732 issued Jan. 10, 1978. These glassy alloys include compositions having the formula $M_aM'_bCr_cM''_dB_{e'}$ where M is one iron group element, (iron, cobalt and nickel), M' is at least one of the two remaining iron group elements, M'' is at least one element of vanadium, manganese, molybdenum, tungsten, niobium and tantalum, B is boron, "a" ranges from about 40 to 85 atom percent, "b" ranges from 0 to about 45 atom percent, "c" and "d" both range from 0 to about 20 atom percent and "e" ranges from about 15 to 25 atom percent, with the provision that "b", "c" and "d" cannot be zero simultaneously. Such glassy alloys are disclosed as having an unexpected combination of improved ultimate tensile strength, improved hardness and improved thermal stability.

These disclosures also mention unusual or unique magnetic properties for many metallic glasses which fall within the scope of the broad claims. However, metallic glasses possessing a combination of higher permeability, lower magnetostriction, lower coercivity, lower core loss, lower exciting power and higher thermal stability than prior art metallic glasses are required for specific applications such as tape recorder heads, relay cores, transformers and the like.

SUMMARY OF THE INVENTION

In accordance with the invention, metallic glasses having a combination of high permeability, low magnetostriction, low coercivity, low ac core loss, low exciting power and high thermal stability are provided. The metallic glasses consist essentially of a composition defined by the formula $Fe_aM_bB_cSi_dC_e$ in which "a"–"e" are in atom percent, the sum ("a"+"b"+"c"+"d"+"e") equals 100, M is at least one element selected from the group consisting of Mo, Cr, Ti, Zr, Hf, Nb, Ta, V and W, "a" ranges from about 66 to 81.5, "b" ranges from about 0.5 to 6, "c" ranges from about 10 to 26, "d" ranges from about 1 to 12, "e" ranges from about 0 to 2 and the sum ("c"+"d"+"e") ranges from about 18 to 28, and have been annealed at a temperature, $T_a$, for a time, $t_a$, sufficient to induce precipitation of discrete particles therein. The metallic glasses of the invention are suitable for use in tape recorder heads, relay cores, transformers and the like.

DETAILED DESCRIPTION OF THE INVENTION

The metallic glasses of the invention are characterized by a combination of high permeability, low saturation magnetostriction, low coercivity, low ac core loss, low exciting power and high thermal stability. The glassy alloys of the invention consist essentially of a composition having the general formula $Fe_aM_bM'_cB_dSi_eC_f$ in which "a"–"f" are in atom percent, the sum ("a"+"b"+"c"+"d"+"e"+"f") equals 100, M is at least one element selected from the group consisting of Ti, Zr, Hf, Nb, Ta and Mo, M' is at least one element selected from the group consisting of Cr, V and W, "a" ranges from about 66 to 81.5, "b" and "c" each range from 0 to 6, the sum ("b"+"c") ranges from about 0.5 to 6, "d" ranges from about 10 to 26, "e" ranges from about 1 to 12, "f" ranges from about 0 to 2 atom percent, the sum ("d"+"e"+"f") ranges from about 18 to 28, and the ratio "e"/("d"+"e'+"f") is less than about 0.4, with the following provisos:

(i) when "b" and "f" are zero and 4.5<"c"<6, then either "e"/("d"+"e") is less than about 0.2 or "e"/("d"+"e") ranges from 0.3 to 0.4;

(ii) when "b" and "f" are zero and 1.5<"c"<4.5, then either "e"/("d"+"e") is less than about 0.25 or "e'/("d"+"e') ranges from about 0.3 to 0.4;

(iii) when "b" and "f" are zero, 0.5<"c"<1.5, and ("d"+"e")<20, then "e"/("d"+"e")<0.25;

(iv) when "c" and "f" are zero, "b"<4, and "e"+"d">21, then "e"/("d"+"e") is less than 0.35;

(v) when "c" and "f" are zero and "b"≧4, then "d"+"e" is greater than about 19 and either "e"/("d"+"e") is less than 0.25 or "e"/("d"+"e") ranges from 0.3 to 0.4. The BH squareness ratio exhibited by such alloys, as cast, is higher than that of prior art Fe-B-Si containing metallic glasses. As a result, the alloys are particularly suited for use in magnetic cores, transducers and the like, in circumstances where annealing of the core is impractical or unnecessary. The term "BH Squareness ratio", as used herein, is defined by the ratio of reminance to saturation magnetization.

It is well known that the magnetization of a ferromagnetic metallic glass decreases with increasing temperature, reaching zero at the Curie temperature. In order that the magnetization be acceptably high over a full range of device operating temperatures, it is desirable that the Curie temperature of a glass be high, preferably at least about 300° C.

The presence of chromium, molybdenum, tungsten, vanadium, niobium, tantalum, zirconium, and/or hafnium has two beneficial effects. First, it improves the properties of permeability, saturation magnetostriction, coercivity, and a-c core loss. Second, it raises the crystallization temperature while simultaneously lowering the Curie temperature of the glassy alloy. The increased separation of these temperatures provides ease of magnetic annealing, that is, thermal annealing at a temperature near the Curie temperature. As is well-known, annealing a magnetic material close to its Curie temperature generally results in improved properties. As a consequence of the increase in crystallization temperature with increase in the concentration of chromium, molybdenum, tungsten, vanadium, niobium, tantalum, titanium, zirconium, and/or hafnium, annealing can be easily accomplished at elevated temperatures near the Curie temperature and below the crystallization temperature. Such annealing cannot be carried out for many alloys similar to those of the invention but lacking these elements. On the other hand, too high a concentration of chromium, molybdenum, tungsten, vanadium, niobium, tantalum, titanium, zirconium and/or hafnium reduces the Curie temperature to a level that may be undesirable in certain applications. For metallic glasses in which boron and silicon are the major and minor metalloid constituents respectively, a preferred range of chromium, molybdenum, tungsten, vanadium, niobium, tantalum, titanium, zirconium and/or hafnium concentration is about 1.5 to 4 atom percent.

It is preferred that the metalloid content consist essentially of (1) substantially boron with a small amount of silicon, (2) boron plus silicon, or (3) boron and silicon plus a small amount of carbon. Preferably, the metalloid content ranges from about 18 to 25 atom percent for maximum thermal stability.

Examples of metallic glasses of the invention include $Fe_{79}Mo_2B_{17}Si_2$, $Fe_{79}Mo_2B_{13}Si_6$, $Fe_{75}Mo_2B_{21}Si_2$, $Fe_{77}Mo_2B_{15}Si_6$, $Fe_{71}Mo_1B_{24}Si_4$, $Fe_{71}Mo_3B_{18}Si_8$, $Fe_{77}Mo_2B_{17}Si_4$, $Fe_{79}Cr_2B_{17}Si_2$, $Fe_{79}Cr_2B_{13}Si_6$, $Fe_{75}Cr_2B_{21}Si_2$, $Fe_{77}Cr_2B_{15}Si_6$, $Fe_{71}Cr_1B_{24}Si_4$, $Fe_{71}Cr_3B_{18}Si_8$, $Fe_{68}Cr_6B_{22}Si_4$, $Fe_{77}Cr_2B_{17}Si_4$, $Fe_{76}Mo_3B_{17}Si_4$, $Fe_{73}Nb_3B_{20}Si_4$, $Fe_{73}Ti_3B_{20}Si_4$, $Fe_{73}Hf_3B_{20}Si_4$, $Fe_{73}Ta_3B_{20}Si_4$, $Fe_{76}Mo_3B_{17}Si_2C_2$, $Fe_{76}Cr_3B_{17}Si_2C_2$, $Fe_{76}Cr_{1.5}Mo_{1.5}B_{17}Si_4$, $Fe_{80}Cr_1B_{17}Si_2$, $Fe_{79.5}Cr_{1.5}B_{17}Si_2$, $Fe_{77.5}Cr_{1.5}B_{16}Si_5$, $Fe_{77.5}Mo_{1.5}B_{16}Si_5$, $Fe_{77}Cr_{1.5}B_{16}Si_5C_{0.5}$, $Fe_{78.5}W_{1.5}B_{17}Si_3$, $Fe_{78}Mo_3B_{17}Si_2$, and $Fe_{78.5}Zr_{1.5}B_{17}Si_3$. The purity of all alloys is that found in normal commercial practice.

Preferred metallic glass systems are as follows:

1. $Fe_aMo_bB_dSi_e$:

(a) When d+e is about 18, the preferred ranges of a, b, d and e are from about 78 to 80.5. from about 1.5 to 4, from about 12 to 17, and from about 1 to 6, respectively.

(b) When d+e is about 22 and b is less than about 4, the preferred ranges of a, b, d and e are from about 74 to 76, from about 2 to 4, from about 14 to 21 and from about 1 to 8, respectively.

(c) When d+e is about 22 and b is greater than 4, the preferred ranges of a and b are from about 72 to 74 and from about 4 to 6; the preferred ranges of d and e are from about 17 to 21 and from about 1 to 5, respectively, or from about 13 to 15.5 and from about 6.5 to 9, respectively;

(d) When d+e is about 25 and b is less than about 4, the preferred ranges of a, b, d, and e are from about 71 to 73, from about 2 to 4, from about 16 to 24, and from about 1 to 9, respectively.

(e) When d+e is about 25 and b is greater than 4, the preferred ranges of a and b are from about 69 to 71 and from about 4 to 6; the preferred ranges of d and e are from about 18.5 to 23 and from about 2 to 6.5, respectively, or from about 15 to 17.5 and from about 7.5 to 10, respectively.

These metallic glasses have a combination of saturation induction ($B_s$) of 1.0–1.4 Tesla, saturation magnetostriction ($\lambda_s$) between 15 and 25 ppm, Curie temperature ($\theta_f$) between about 250° and 425° C. and first crystallization temperatures of 500°–620° C. When optimally heat-treated, these alloys have excellent ac magnetic properties especially at high frequencies ($f>10^3$ Hz). The ac core loss (L) and exciting power ($P_e$) taken at f=50 kHz and at the induction level of $B_m=0.1$ Tesla of, for example, a heat-treated metallic glass $Fe_{78}Mo_3B_{17}Si_2$ are 7 W/kg and 16.5 VA/kg, respectively. These values are to be compared with L=7 W/kg and $P_e=20$ VA/kg for a heat-treated prior art metallic glass of the same thickness having the composition $Fe_{79}B_{16}Si_5$. The permeability $\mu$ at $B_m=0.01$ Tesla is 8500 and 8000 for the heat-treated $Fe_{78}Mo_3B_{17}Si_2$ and $Fe_{79}B_{16}Si_5$, respectively. The smaller saturation magnetrostriction ($\lambda_s$) of about 19 ppm of the present alloy as compared to $\lambda$ $\lambda_s=30$ ppm for the aforesaid prior art alloy makes the alloys of the present invention especially suited for magnetic device applications such as cores for high frequency transformers. Beyond f=50 kHz, the alloys of the present invention have permeabilities comparable or higher than those for crystalline supermalloys which have $B_s$ near 0.8 Tesla. The higher value of $B_s$ for the present alloys make these alloys better suited than supermalloys for magnetic application of f>50 kHz.

2. $Fe_aCr_cB_dSi_e$:

(a) When d+e is about 18, the preferred ranges of a, c, d and e are from about 78 to 80.5, from about 1.5 to 4, from about 13.5 to 17, and from about 1 to 4.5, respectively.

(b) When d+e is about 22, the preferred ranges for a and c are from about 73.5 to 76.5 and from about 1.5 to 4.5, respectively; the preferred ranges for d and e are either from about 16.5 to 21 and from about 1 to 5.5, respectively, or from about 17 to 21 and from about 6.5 to 9, respectively.

(c) When d+e is about 25, the preferred ranges for a and c are from about 70.5 to 73 and from about 2 to 4.5, respectively, and the preferred ranges of d and e are from about 18.5 to 23 and from about 2 to 6.5, respectively, or from about 15 to 17.5 and from about 7.5 to 10, respectively.

3. $Fe_aM_bB_dSi_e$, where M is at least one member selected from the group consisting of W, V, Nb, Ta, Ti, Zr, or Hf:

(a) When d+e is about 18, the preferred ranges of a, b, d and e are from about 78 to 80.5, from about 1.5 to 4, from about 13.5 to 17, and from about 1 to 4.5, respectively.

(b) When d+e is about 22, the preferred ranges for a and b are from about 73.5 to 76.5 and from about 1.5 to 4.5, respectively; the preferred ranges for d and e are either from about 16.5 to 21 and from about 1.5 to 5.5, respectively, or from about 17 to 21 and from about 6.5 to 9, respectively.

4. $Fe_aM_bB_dSi_eC_f$, where M is at least one member selected from the group consisting of Mo, Ti, Zr, Hf, Nb, Ta, Cr, W, and V.

(a) When d+e+f is about 18, the preferred ranges of a, b, d, e and f are from about 78 to 80.5, from about 1.5 to 4, from about 11 to 17, from about 1 to 6, and from about 0 to 2, respectively.

(b) When d+e+f is about 22, the preferred ranges of a, b, d, e and f are from about 73.5 to 76, from about 2 to 4.5, from about 13 to 25, from about 1 to 8, and from about 0 to 2, respectively.

Magnetic permeability is the ratio of induction in a magnetic material to applied magnetic field. A higher permeability renders a material more useful in certain applications such as tape recorder heads, due to the increased response. The frequency dependence of permeability of the glassy alloys of the invention is similar to that of the 4–79 Permalloys in the medium-to-high frequency range (1–50 kHz), and at higher frequencies (about 50 kHz to 1 MHz), the permeability is comparable to that of the supermalloys. Especially noted is the fact that a heat-treated $Fe_{78}Mo_3B_{17}Si_2$ metallic glass has permeability of 7000 while the best-heat-treated prior art $Fe_{40}Ni_{36}Mo_4B_{20}$ metallic glass has a permeability of 2500 at 50 kHz and the induction level of 0.01 Tesla.

Saturation magnetostriction is the change in length of a magnetic material under the influence of a saturating magnetic field. A lower saturation magnetostriction renders a material more useful in certain application such as tape recorder heads. Magnetostriction is usually discussed in terms of the ratio of the change in length to the original length, and is given in ppm. Prior art iron-rich metallic glasses evidence saturation magnetostrictions of about 30 ppm as do metallic glasses without the presence of the any of the elements belonging to the IVB, VB and VIB columns of the periodic table such as molybdenum. For example, a prior art iron-rich metallic glass designated for use in high frequency applications and having the composition $Fe_{79}B_{16}Si_5$ has a saturation magnetostriction of about 30 ppm. In contrast, a metallic glass of the invention having the composition $Fe_{78}Mo_3B_{17}Si_2$ has a saturation magnetostriction of about 19 ppm. A lower saturation magnetostriction leads to a lower phase angle between the exciting field and the resulting induction. This results in lower exciting power as discussed below.

As core loss is that energy loss dissipated as heat. It is the hysteresis in an ac field and is measured by the area of a B-H loop for low frequencies (less than about 1 kHz) and from the complex input power in the exciting coil for high frequencies (about 1 kHz to 1 MHz). The major portion of the ac core loss at high frequencies arises from the eddy current generated during flux change. However, a smaller hysteresis loss and hence a smaller coercivity is desirable. A lower core loss renders a material more useful in certain applications such as tape recorder heads and transformers. Core loss is discussed in units of watts/kg. Prior art heat-treated metallic glasses typically evidence ac core losses of about 0.05 to 0.1 watts/kg at an induction of 0.1 Tesla and at the frequency range of 1 kHz. For example, a prior art heat-treated metallic glass having the composition $Fe_{40}Ni_{36}Mo_4B_{20}$, has an ac core loss of 0.07 watts/kg at an induction of 0.1 Tesla and at the frequency of 1 kHz, while a metallic glass having the composition $Fe_{76}Mo_4B_{20}$ has an ac core loss of 0.08 watts/kg at an induction of 0.1 Tesla and at the same frequency. In contrast, a metallic glass alloy of the invention having the composition $Fe_{78}Mo_3B_{17}Si_2$ has an ac core loss of 0.045 watts/kg at an induction of 0.1 Tesla and at the same frequency.

Exciting power is a measure of power required to maintain a certain flux density in a magnetic material. It is therefore desirable that a magnetic material to be used in magnetic devices have an exciting power as low as possible. Exciting power ($P_e$) is related to the above-mentioned core loss (L) through the relationship $L=P_e \cos \delta$ where $\delta$ is the phase shift between the exciting field and the voltage induced in a coil sensing the resultant induction. The phase shift is also related to the magnetostriction in such a way that a lower magnetostriction value leads to a lower phase shift. It is then advantageous to have the magnetostriction value as low as possible. As mentioned earlier, prior art iron-rich metallic glasses such as $Fe_{79}B_{16}Si_5$ have the magnetostriction value near 30 ppm, in contrast to the magnetostriction value of about 20 ppm of the metallic glasses of the present invention. This difference results in a considerable phase shift difference. For example, optimally annealed prior art metallic glass $Fe_{79}B_{16}Si_5$ has $\delta$ near 70° while the metallic glasses of the present invention have $\delta$ near 50° at 50 KHz and 0.1T induction. This results, for a given core loss, in a higher exciting power by a factor of two for the prior art metallic glass than the metallic glass of the present invention.

Crystallization temperature is the temperature at which a metallic glass begins to crystallize. A higher crystallization temperature renders a material more useful in high temperature applications and, in conjunction with a Curie temperature that is substantially lower than the crystallization temperature, permits magnetic annealing just above the Curie temperature. Some metalic glasses crystallize in multiple steps. In such cases, the first crystallization temperature (the lowest value of the crystallization temperatures) is the meaningful one as far as the materials' thermal stability is concerned. The crystallization temperature as discussed herein is measured by differential scanning calorimetry at a heating rate of 20° C./min. Prior art glassy alloys evidence crystallization temperatures of about 385° to 475° C. For example, a metallic glass having the composition $Fe_{78}Mo_2B_{20}$ has a crystallization temperature of 407° C., while a metallic glass having the composition $Fe_{74}Mo_6B_{20}$ has a crystallization temperature of 477° C. In contrast, metallic glasses of the invention evidence increases in crystallization temperatures to a level above 500° C.

The magnetic properties of the metallic glasses of the present invention are improved by thermal treatment, characterized by choice of annealing temperatures ($T_a$), holding time ($t_a$), applied magnetic field (either parallel or perpendicular to the ribbon direction and in the ribbon plane), and post-treatment cooling rate. For the present alloys, the optimal properties are obtained after an anneal which causes the controlled precipitation of a certain number of crystalline particles from the glassy matrix. Under these conditions, for compositions having boron content ranging from about 10 to 20 atom percent, the discrete particles have a body-centered cubic structure. The particles are composed essentially of iron, up to 20 atom percent of the iron being adapted to be replaced by at least one of chromium, molybdenum, tungsten, vanadium, niobium, tantalum, titanium, zirconium, hafnium, silicon and carbon. For compositions having boron content ranging from about 21 to 26 atom percent and iron content ranging from about 69 to 78 atom percent, the discrete particles consist essentially of a mixture of particles, a major portion of which mixture contains particles having a crystalline $Fe_3B$ structure. The particles of such portion are composed of iron and boron, up to 6 atom percent of the iron being adapted to be replaced by at least one of chromium, molybdenum, tungsten, vanadium, niobium, tantalum, titanium, zirconium and hafnium and up to 2 atom percent of the boron being adapted to be replaced by carbon. A small number of such particles introduces a certain decrease in the average domain wall spacing with concomitant decrease in core loss. Too large a number of particles increases the coercivity and thus the hysteresis loss. A metallic glass of the present invention with composition $Fe_{78}Mo_3B_{17}Si_2$ has a combination of low loss and high permeability with a coercivity of only 2.8 A/m when optimally annealed for lowest high frequency core loss. In contrast to this, an optimally annealed prior art metallic glass $Fe_{79}B_{16}Si_5$ has a coercivity of about 8 A/m. The crystalline particle size in the optimally heat-treated materials of the present invention ranges between 100 and 300 nm, and their volume fraction of said crystalline particles is less than 1%. The interparticle spacing is of the order of 1–10 μm.

Depending on the composition of the given glass and the annealing conditions, the precipitated crystalline particles either are homogeneously distributed throughout the metallic glass sample or are concentrated predominantly at or near either or both of the surfaces of the metallic glass. It is preferred that the particles be distributed homogeneously, in order that the magnetic coercivity be lower and the thermal stability higher. The addition of about 1 to 4 at.% Cr or Mo to an FeBSi containing glassy alloy is especially helpful in promoting a homogeneous distribution of said crystalline particles. The lowest values of core loss and exciting power are exhibited by alloys in which the metalloid content ranges from about 18–23, the silicon content ranges from about 1–8 and the content of the Cr and Mo present ranges from about 1–4 atom percent.

It is an advantage of alloys of the present invention that acceptable high frequency magnetic properties can be achieved using an anneal cycle without an external applied magnetic field. It is frequently difficult to apply such a field in the desired direction during the annealing of magnetic implements which have been fabricated in irregular shapes for device application. Prior art alloys, such as $Fe_{79}B_{16}Si_5$, have required an applied field during anneal to achieve desired properties.

In summary, the metallic glasses of the invention have a combination of high permeability, low saturation magnetostriction, low coercivity, low ac core loss, low exciting power and high crystallization temperature and are useful as tape heads, relay cores, transformers and the like.

The metallic glasses of the invention are prepared by cooling a melt of the desired composition at a rate of at least about $10^{5°}$ C./sec, employing quenching techniques well known to the metallic glass art; see e.g., U.S. Pat. No. 3,856,513. The metallic glasses are substantially completely glassy, that is, at least 90% glassy, and consequently possess lower coercivities and are more ductile than less glassy alloys.

A variety of techniques are available for fabricating continuous ribbon, wire, sheet, etc. Typically, a particular composition is selected, powders or granules of the requisite elements in the desired portions are melted and homogenized and the molten alloy is rapidly quenched on a chill surface such as a rapidly rotating cylinder.

EXAMPLES

Example 1: Fe-Mo-B-Si System

Ribbons having compositions given by $Fe_{100-a-b-c}Mo_aB_bSi_c$ and having dimensions about 1 to 2.5 cm wide and about 25 to 50 μm thick were formed by squirting a melt of the particular composition by overpressure of argon onto a rapidly rotating copper chill wheel (surface speed about 3000 to 6000 ft/min).

Molybdenum content was varied from 1 to 6 atom percent, for which substantially glassy ribbons were obtained. Molybdenum content higher than 6 atom percent reduced the Curie temperature to an unacceptable low value.

Permeability, magnetostriction, core loss, magnetization and coercive force were measured by conventional techniques employing B-H loops, metallic strain gauges and a vibrating sample magnetometer. Curie temperature and crystallization temperature were measured respectively by an induction method and differential scanning calorimetry. Mass density was measured by an Archimedean technique. The measured values of mass density, room temperature saturation induction, Curie temperature, room temperature saturation magnetostriction and the first crystallization temperature are summarized in Table I below. The magnetic properties of these glassy alloys after annealing are present in Table II. Optimum annealing conditions for the metallic glass $Fe_{78}Mo_3B_{17}Si_2$ and the obtained results are summarized in Table III. Frequency dependence of permeability and ac core loss of this optimally annealed alloy are listed in Table IV.

The presence of molybdenum is seen to increase the permeability and the crystallization temperature and to lower the ac core loss, exciting power and magnetostriction. Especially noted is the fact that the optimally heat-treated metallic glass $Fe_{78}Mo_3B_{17}Si_2$ of the present invention has a coercivity reaching as low as 2.8 A/m and yet has a low core loss of 7 W/kg and permeability of 10,500 at 50 kHz and at the induction level of 0.1 Tesla. The combination of those properties make these compositions suitable for high frequency transformer and tape-head applications.

TABLE I

Examples of basic physical and magnetic properties of Fe-Mo-B-Si amorphous alloys. $\theta_f$ and $T_{x1}$ are the ferromagnetic Curie and first crystallization temperatures, respectively. $B_s$ and $\lambda_s$ are the room temperature saturation induction and saturation magnetostriction, respectively. $\rho$ is the mass density.

TABLE I

| Composition | | | | $\theta_f$ | | | $\lambda$ | |
|---|---|---|---|---|---|---|---|---|
| Fe | Mo | B | Si | (°C.) | $B_s$(T) | $\rho$(g/cm$^3$) | ($10^{-6}$) | $T_{x1}$(°C.) |
| 79 | 2 | 17 | 2 | 299 | 1.35 | 7.47 | 21.9 | 509 |
| 79 | 2 | 15 | 4 | 318 | 1.42 | 7.43 | 24.3 | 517 |
| 79 | 2 | 13 | 6 | 300 | 1.36 | 7.39 | 24.4 | 511 |
| 77 | 2 | 19 | 2 | 319 | 1.41 | 7.47 | 22.6 | 522 |
| 77 | 2 | 17 | 4 | 352 | 1.41 | 7.43 | 25.4 | 532 |
| 77 | 2 | 15 | 6 | 335 | 1.38 | 7.37 | 26.2 | 548 |
| 75 | 2 | 21 | 2 | 357 | 1.39 | 7.48 | 21.4 | 538 |
| 75 | 2 | 19 | 4 | 352 | 1.36 | 7.37 | 21.7 | 552 |
| 75 | 2 | 17 | 6 | 355 | 1.38 | 7.48 | 22.9 | 561 |
| 78 | 3 | 17 | 2 | 256 | 1.30 | 7.61 | 19.0 | 520 |
| 78 | 3 | 15 | 4 | 282 | 1.35 | 7.51 | 21.3 | 524 |
| 78 | 3 | 13 | 6 | 258 | 1.27 | 7.43 | 18.9 | 519 |
| 76 | 3 | 19 | 2 | 283 | 1.26 | 7.42 | 18.2 | 534 |

TABLE I-continued

| Composition | | | | $\theta_f$ | | | λ | |
|---|---|---|---|---|---|---|---|---|
| Fe | Mo | B | Si | (°C.) | $B_s$(T) | ρ(g/cm$^3$) | ($10^{-6}$) | $T_{x1}$(°C.) |
| 76 | 3 | 17 | 4 | 318 | 1.34 | 7.37 | 22.7 | 539 |
| 76 | 3 | 15 | 6 | 287 | 1.29 | 7.40 | 21.4 | 552 |
| 74 | 3 | 21 | 2 | 326 | 1.29 | 7.45 | 19.3 | 550 |
| 74 | 3 | 19 | 4 | 312 | 1.28 | 7.40 | 19.1 | 560 |
| 74 | 3 | 17 | 6 | 314 | 1.28 | — | 19.3 | 565 |
| 71 | 1 | 24 | 4 | 433 | 1.42 | — | 21.3 | 561 |
| 72 | 6 | 18 | 4 | 234 | 1.07 | 7.46 | 13.0 | 569 |
| 70 | 6 | 20 | 4 | 202 | 0.94 | — | 10.7 | 588 |
| 68 | 6 | 22 | 4 | 229 | 0.95 | — | 12.8 | 618 |
| 72 | 4 | 20 | 4 | 400 | 1.41 | — | 25.1 | 563 |
| 74 | 2 | 20 | 4 | 370 | 1.33 | 7.40 | 23.3 | 601 |
| 73 | 3 | 20 | 4 | 379 | 1.33 | — | 20.6 | 541 |
| 66 | 6 | 24 | 4 | 309 | 1.22 | — | 15.6 | 599 |
| 77 | 2 | 13 | 8 | 328 | 1.34 | — | 21.8 | 545 |
| 75 | 2 | 15 | 8 | 353 | 1.41 | — | 23.7 | 574 |
| 71 | 3 | 20 | 6 | 372 | 1.38 | — | 20.0 | 583 |
| 71 | 3 | 18 | 8 | 421 | 1.44 | — | 17.8 | 579 |
| 71 | 3 | 16 | 10 | 388 | 1.33 | — | 21.6 | 585 |
| 77.5 | 1.5 | 16 | 5 | 359 | 1.45 | — | 26.6 | 536 |
| 66 | 6 | 18 | 10 | 234 | 0.92 | — | 7.12 | 616 |
| 72 | 1 | 26 | 1 | 440 | 1.43 | — | 18.94 | 505 |
| 77 | 2 | 20 | 1 | 329 | 1.40 | — | 23.20 | 518 |
| 78.5 | 0.5 | 16 | 5 | 395 | 1.46 | — | 24.4 | 525 |

TABLE II

Examples of high frequency magnetic properties of Fe-Mo-B-Si alloys. The alloys were annealed at temperature $T_a$ for a time $t_a$ without applied field and subsequently cooled at a rate of about −1° C./min. Exciting power ($P_e$), core loss (L), and permeability (μ) were measured at a frequency of f=50 kHz and at a maximum induction level $B_m$=0.1 Tesla. Hc is the dc coercivity.

TABLE II

| Composition | | | | | | | | | |
|---|---|---|---|---|---|---|---|---|---|
| Fe | Mo | B | Si | $T_a$(°C.) | $t_a$(h) | $P_e$(VA/kg) | L(W/kg) | μ | $H_c$(A/m) |
| 79 | 2 | 17 | 2 | 395 | 2 | 21.0 | 7.4 | 8080 | 5.6 |
| 79 | 2 | 15 | 4 | 395 | 2 | 15.6 | 9.3 | 10500 | 4.6 |
| 79 | 2 | 13 | 6 | 395 | 2 | 20.7 | 10.3 | 8160 | 2.9 |
| 77 | 2 | 19 | 2 | 395 | 2 | 22.5 | 11.7 | 7535 | 3.8 |
| 77 | 2 | 17 | 4 | 395 | 2 | 24.9 | 12.3 | 6820 | 3.8 |
| 77 | 2 | 15 | 6 | 420 | 2 | 30.8 | 13.3 | 5500 | 5.7 |
| 75 | 2 | 21 | 2 | 420 | 2 | 28.6 | 13.2 | 5900 | 5.0 |
| 75 | 2 | 19 | 4 | 420 | 2 | 35.7 | 18.5 | 4750 | 4.5 |
| 75 | 2 | 17 | 6 | 420 | 2 | 29.2 | 11.6 | 5796 | 5.9 |
| 78 | 3 | 17 | 2 | 420 | 2 | 23.6 | 10.8 | 5900 | 5.9 |
| 78 | 3 | 15 | 4 | 420 | 2 | 32.9 | 12.6 | 5130 | 6.8 |
| 78 | 3 | 13 | 6 | 420 | 2 | 28.2 | 16.7 | 6000 | 2.8 |
| 76 | 3 | 19 | 2 | 420 | 2 | 27.3 | 12.2 | 6200 | 3.8 |
| 76 | 3 | 17 | 4 | 400 | 1 | 25.6 | 13.7 | 6510 | 3.1 |
| 76 | 3 | 15 | 6 | 420 | 2 | 38.3 | 18.0 | 4400 | 11.7 |
| 74 | 3 | 21 | 2 | 420 | 2 | 25.2 | 10.7 | 6720 | 5.0 |
| 74 | 3 | 19 | 4 | 420 | 2 | 28.0 | 13.7 | 6048 | 3.6 |
| 74 | 3 | 17 | 6 | 420 | 2 | 23.5 | 12.9 | 7170 | 3.1 |
| 71 | 1 | 24 | 4 | 420 | 2 | 32.7 | 13.0 | 5180 | 4.7 |
| 72 | 6 | 18 | 4 | 420 | 2 | 30.0 | 13.4 | 5560 | 2.8 |
| 70 | 6 | 20 | 4 | 420 | 2 | 35.4 | 14.1 | 4780 | 4.0 |
| 68 | 6 | 22 | 4 | 420 | 2 | 34.9 | 19.0 | 4860 | 2.3 |
| 72 | 4 | 20 | 4 | 420 | 2 | 25.9 | 12.7 | 6540 | 4.9 |
| 74 | 2 | 20 | 4 | 420 | 2 | 24.6 | 10.6 | 6890 | 4.0 |
| 73 | 3 | 20 | 4 | 420 | 2 | 26.4 | 11.4 | 6420 | 3.9 |
| 66 | 6 | 24 | 4 | 420 | 2 | 32.8 | 10.3 | 5180 | 10.0 |
| 77 | 2 | 13 | 8 | 420 | 2 | 27.0 | 16.1 | 5250 | 2.9 |
| 75 | 2 | 15 | 8 | 420 | 2 | 25.4 | 17.2 | 6670 | 2.0 |
| 71 | 3 | 20 | 6 | 420 | 2 | 26.8 | 16.3 | 6270 | 3.4 |
| 71 | 3 | 18 | 8 | 420 | 2 | 48.4 | 25.8 | 3460 | 7.4 |
| 71 | 3 | 16 | 10 | 420 | 2 | 34.6 | 18.1 | 4890 | 5.3 |
| 77.5 | 1.5 | 16 | 5 | 430 | 2 | 24.6 | 11.9 | 6780 | 4.8 |
| 66 | 6 | 18 | 10 | 400 | 2 | 32.5 | 19.0 | 5140 | 2.5 |
| 72 | 1 | 26 | 1 | 400 | 2 | 31.5 | 14.6 | 5290 | 6.8 |
| 77 | 2 | 20 | 1 | 420 | 2 | 32.1 | 15.4 | 5260 | 4.3 |
| 78.5 | 0.5 | 16 | 5 | 430 | 2 | 18.7 | 8.5 | 8930 | 7.7 |

TABLE III. Annealing conditions for metallic glass $Fe_{78}Mo_3B_{17}Si_2$ and resulting values of core loss L and permeability μ, measured at f=50 kHz with a maximum induction $B_m$=0.1T. $H_c$ is the dc coercivity of the annealed glass.

TABLE III

| Ta(°C.) | ta(h) | L(W/kg) | μ | Hc(A/m) |
|---|---|---|---|---|
| 400 | 0.25 | 9.3 | 10020 | 2.2 |
| 400 | 0.5 | 7.3 | 10700 | 2.9 |
| 400 | 1.0 | 9.7 | 8860 | 2.3 |
| 400 | 1.5 | 8.3 | 10490 | 2.6 |
| 400 | 2.0 | 7.3 | 10150 | 2.8 |
| 400 | 4.0 | 7.5 | 9140 | 3.5 |
| 400 | 6.0 | 8.1 | 8520 | 3.8 |
| 320 | 0.25 | 20.3 | 4660 | 2.8 |
| 340 | 0.25 | 16.2 | 5891 | 2.5 |
| 360 | 0.25 | 16.1 | 6110 | 2.2 |
| 380 | 0.25 | 13.5 | 7130 | 2.0 |
| 420 | 0.25 | 8.1 | 10690 | 2.5 |
| 440 | 0.25 | 8.3 | 9230 | 3.2 |
| 460 | 0.25 | 9.2 | 7860 | 4.5 |
| 400* | 2.0 | 7.5 | 14080 | 2.6 |
| 400** | 2.0 | 8.2 | 9950 | 3.1 |

*Annealed with a 1.6 KA/m field along the circumference of the toroidally wound ribbon.

**Annealed with a 1.6 KA/m field transverse to the toroidally wound ribbon.

TABLE IV. Frequency dependence of the permeability (μ) and ac core loss (L) at the induction level $B_m$=0.01 and 0.1 Tesla, for an optimally annealed $Fe_{78}Mo_3B_{17}Si_2$ metallic glass.

TABLE IV

| | $B_m$ = 0.01 T | | $B_m$ = 0.1 T | |
|---|---|---|---|---|
| f(kHz) | L(W/kg) | μ | L(W/kg) | μ |
| 1 | 0.00016 | 10850 | 0.046 | 16080 |

TABLE IV-continued

| f(kHz) | $B_m = 0.01$ T L(W/kg) | $B_m = 0.01$ T $\mu$ | $B_m = 0.1$ T L(W/kg) | $B_m = 0.1$ T $\mu$ |
|---|---|---|---|---|
| 10 | 0.0037 | 9820 | 0.68 | 13070 |
| 20 | 0.013 | 10060 | 1.79 | 12420 |
| 50 | 0.066 | 6970 | 7.3 | 10150 |

Example 2: Fe-Cr-B-Si System

Ribbons having compositions given by $Fe_{100-a-b-c}Cr_aB_bSi_c$ and having dimensions about 1 cm wide and about 25 to 50 μm thick were formed as in Example 1.

Chromium content was varied from 1 to 6 atom percent, for which substantially glassy ribbons were obtained. Higher Cr content reduced the Curie temperature to an unacceptably low value.

The magnetic and thermal data are summarized in Table V below. The magnetic properties of these glassy alloys after annealing are presented in Table VI.

Low field magnetic properties of these metallic glasses were comparable to those for the metallic glasses containing molybdenum (Example 1).

A combination of low ac core loss and high permeability at high frequency is achieved in the metallic glasses of the present invention. The thermal stability is also shown to be excellent as evidenced by high crystallization temperature. These improved combination of properties of the metallic glasses of the present invention renders these compositions suitable in the magnetic cores of transformers, tape-recording heads and the like.

TABLE V

Examples of basic physical and magnetic properties of Fe-Cr-B-Si amorphous alloys. $\theta_f$ and $T_{x1}$ are the ferromagnetic Curie and first crystallization temperatures, respectively. $B_s$ and $\lambda_s$ are the room temperature saturation induction and saturation magnetostriction, respectively. $\rho$ is the mass density.

TABLE V

| Fe | Cr | B | Si | $\theta_f$ (°C.) | $B_s$(T) | $\rho$(g/cm$^3$) | $\lambda_s$ ($10^{-6}$) | $T_{x1}$(°C.) |
|---|---|---|---|---|---|---|---|---|
| 71 | 1 | 24 | 4 | 444 | 1.41 | — | 15.8 | 537 |
| 79 | 2 | 17 | 2 | 309 | 1.44 | 7.46 | 23.8 | 494 |
| 79 | 2 | 15 | 4 | 315 | 1.44 | — | 26.6 | 503 |
| 77 | 2 | 19 | 2 | 341 | 1.42 | — | 24.5 | 499 |
| 77 | 2 | 17 | 4 | 344 | 1.43 | 7.33 | 26.4 | 514 |
| 75 | 2 | 21 | 2 | 371 | 1.42 | — | 14.5 | 506 |
| 75 | 2 | 19 | 4 | 372 | 1.40 | 7.36 | 21.4 | 534 |
| 78 | 3 | 17 | 2 | 283 | 1.33 | 7.37 | 19.8 | 496 |
| 78 | 3 | 13 | 6 | 297 | 1.32 | 7.30 | 20.3 | 497 |
| 78 | 3 | 15 | 4 | 289 | 1.33 | — | 20.9 | 504 |
| 76 | 3 | 19 | 2 | 314 | 1.35 | — | 22.2 | 500 |
| 76 | 3 | 17 | 4 | 315 | 1.33 | 7.40 | 20.0 | 518 |
| 74 | 3 | 21 | 2 | 343 | 1.32 | 7.25 | 23.0 | 506 |
| 74 | 3 | 19 | 4 | 342 | 1.32 | — | 22.4 | 538 |
| 72 | 6 | 18 | 4 | 251 | 1.09 | — | 11.1 | 534 |
| 70 | 6 | 20 | 4 | 299 | 1.18 | — | 10.2 | 550 |
| 68 | 6 | 22 | 4 | 297 | 1.10 | — | 12.8 | 549 |
| 66 | 6 | 24 | 4 | 297 | 1.06 | — | 12.2 | 545 |
| 72 | 4 | 20 | 4 | 313 | 1.24 | — | 12.2 | 599 |
| 74 | 2 | 20 | 4 | 386 | 1.40 | — | 11.1 | 545 |
| 73 | 3 | 20 | 4 | 362 | 1.33 | — | 17.9 | 547 |
| 77 | 2 | 13 | 8 | 400 | 1.52 | — | 32.6 | 531 |
| 71 | 3 | 20 | 6 | 355 | 1.27 | — | 20.3 | 552 |
| 71 | 3 | 18 | 8 | 367 | 1.31 | 7.09 | 18.6 | 568 |
| 71 | 3 | 16 | 10 | 354 | 1.23 | — | 16.3 | 578 |
| 75 | 2 | 15 | 8 | 368 | 1.40 | 7.58 | 15.4 | 553 |
| 80 | 1 | 17 | 2 | 341 | 1.47 | — | 27.3 | 494 |
| 79.5 | 1.5 | 17 | 2 | 338 | 1.45 | 7.25 | 28.1 | 497 |
| 77.5 | 1.5 | 16 | 5 | 360 | 1.48 | — | 28.8 | 520 |
| 79.8 | 2 | 13.4 | 4.8 | 309 | 1.33 | 7.28 | 25.9 | 487 |
| 77 | 2 | 15.8 | 5.2 | 360 | 1.40 | — | 24.0 | 523 |
| 75 | 2 | 17.8 | 5.2 | 369 | 1.40 | — | 26.6 | 536 |
| 76 | 3 | 15.8 | 5.2 | 323 | 1.33 | 7.23 | 23.5 | 526 |
| 74 | 3 | 17.8 | 5.2 | 346 | 1.30 | — | 23.4 | 541 |
| 78.5 | 0.5 | 16 | 5 | 395 | 1.35 | — | 24.9 | 520 |

TABLE VI

Examples of high frequency magnetic properties of Fe-Cr-B-Si alloys. The alloys were annealed at temperature $T_a$ for a time $t_a$ without applied field and subsequently cooled at a rate of about −1° C./min. Exciting power ($P_e$), core loss (L), and permeability ($\mu$) were measured at a frequency of f=50 kHz and at a maximum induction level $B_m$32 0.1 Tesla. $H_c$ is the dc coercivity.

TABLE VI

| Fe | Cr | B | Si | $T_a$(°C.) | $t_a$(h) | $P_e$(VA/kg) | L(W/kg) | $\mu$ | $H_c$(A/m) |
|---|---|---|---|---|---|---|---|---|---|
| 71 | 1 | 24 | 4 | 420 | 2 | 47.9 | 22.0 | 3540 | 7.3 |
| 79 | 2 | 17 | 2 | 395 | 2 | 26.7 | 14.9 | 6330 | 5.0 |
| 79 | 2 | 15 | 4 | 395 | 2 | 23.0 | 11.8 | 7370 | 5.6 |
| 77 | 2 | 19 | 2 | 420 | 2 | 26.7 | 11.8 | 6330 | 9.4 |
| 77 | 2 | 17 | 4 | 420 | 2 | 25.5 | 12.3 | 6650 | 5.3 |
| 75 | 2 | 21 | 2 | 420 | 2 | 17.6 | 8.3 | 9600 | 7.0 |
| 75 | 2 | 19 | 4 | 372 | 2 | 19.6 | 13.3 | 8630 | 4.5 |
| 78 | 3 | 17 | 2 | 420 | 2 | 30.4 | 16.5 | 3580 | 5.4 |
| 78 | 3 | 13 | 6 | 420 | 2 | 24.9 | 14.9 | 6800 | 4.7 |
| 78 | 3 | 15 | 4 | 420 | 2 | 29.3 | 15.1 | 5750 | 4.7 |
| 76 | 3 | 19 | 2 | 420 | 2 | 30.9 | 18.8 | 5490 | 3.9 |
| 76 | 3 | 17 | 4 | 420 | 2 | 30.4 | 19.6 | 5580 | 1.5 |
| 74 | 3 | 21 | 2 | 420 | 2 | 27.3 | 11.1 | 6240 | 6.4 |
| 74 | 3 | 19 | 4 | 420 | 2 | 27.4 | 18.6 | 6290 | 2.2 |
| 72 | 6 | 18 | 4 | 420 | 2 | 35.0 | 22.5 | 4810 | 3.5 |
| 70 | 6 | 20 | 4 | 420 | 2 | 39.4 | 24.9 | 4250 | 3.6 |
| 68 | 6 | 22 | 4 | 420 | 2 | 23.0 | 14.8 | 7350 | 4.5 |
| 66 | 6 | 24 | 4 | 420 | 2 | 29.9 | 14.0 | 5693 | 4.6 |
| 72 | 4 | 20 | 4 | 420 | 2 | 21.5 | 12.0 | 7920 | 4.5 |
| 74 | 2 | 20 | 4 | 420 | 2 | 31.4 | 16.9 | 5400 | 5.7 |
| 73 | 3 | 20 | 4 | 420 | 2 | 33.2 | 18.5 | 5120 | 4.0 |
| 77 | 2 | 13 | 8 | 395 | 2 | 34.9 | 21.5 | 4840 | 4.4 |
| 71 | 3 | 20 | 6 | 420 | 2 | 35.5 | 22.3 | 4780 | 2.2 |
| 71 | 3 | 18 | 8 | 420 | 2 | 35.5 | 23.9 | 4750 | 2.5 |
| 71 | 3 | 16 | 10 | 420 | 2 | 50.8 | 26.6 | 3340 | 5.2 |
| 75 | 2 | 15 | 8 | 420 | 2 | 32.5 | 16.9 | 5220 | 7.3 |
| 80 | 1 | 17 | 2 | 390 | 2 | 33.0 | 18.1 | 5050 | 5.7 |

TABLE VI-continued

| Fe | Cr | B | Si | $T_a$(°C.) | $t_a$(h) | $P_e$(VA/kg) | L(W/kg) | $\mu$ | $H_c$(A/m) |
|---|---|---|---|---|---|---|---|---|---|
| 79.5 | 1.5 | 17 | 2 | 390 | 2 | 29.0 | 15.7 | 5760 | 5.0 |
| 77.5 | 1.5 | 16 | 5 | 430 | 2 | 20.9 | 13.3 | 8000 | 5.0 |
| 78.5 | 0.5 | 16 | 5 | 430 | 2 | 25.3 | 12.2 | 6610 | 4.3 |
| 79.8 | 2 | 13.4 | 4.8 | 385 | 2 | 22.6 | 13.6 | 7580 | 6.1 |
| 74 | 3 | 17.8 | 5.2 | 430 | 2 | 25.4 | 14.9 | 6780 | 2.0 |
| 77 | 2 | 15.8 | 5.2 | 430 | 2 | 18.4 | 10.8 | 9050 | 5.3 |
| 75 | 2 | 17.8 | 5.2 | 430 | 2 | 31.1 | 16.6 | 5380 | 4.2 |
| 76 | 3 | 15.8 | 5.2 | 430 | 2 | 29.7 | 14.3 | 5610 | 4.6 |

Example 3: Fe-M-B-Si System

Ribbons having compositions given by $Fe_{100-a-b-c}M_aB_bSi_c$ when M is one of the elements tungsten, vanadium, niobium, tantalum, titanium, zirconium and hafnium, and having dimensions about 1 cm wide and about 25 to 50 μm thick were formed as in Example 1.

Metal "M" content was varied from 1 to 6 atom percent, for which substantially glassy ribbons were obtained. Higher metal "M" content reduced the Curie temperature to an unacceptably low value.

The magnetic and thermal data are summarized in Table VII below. The magnetic properties of these glassy alloys after annealing are presented in Table VIII.

Low field magnetic properties of these metallic glasses were comparable to those for the metallic glasses containing molybdenum. (Example 1).

A combination of low ac core loss and high permeability at high frequency is achieved in the metallic glasses of the present invention. The thermal stability is also shown to be excellent as evidenced by high crystallization temperature. This improved combination of properties of the metallic glasses of the present invention renders these compositions suitable for the magnetic cores of transformers, tape-recording heads and the like.

TABLE VII

Examples of basic physical and magnetic properties of Fe-M-B-Si amorphous alloys, where M=Nb, V, W, Zr, Ti, Hf, or Ta. $\theta_f$ and $T_{x1}$ are the ferromagnetic and first crystallization temperatures, respectively. $B_s$ and $\lambda_s$ are the room temperature saturation induction and saturation magnetostriction, respectively. $\rho$ is the mass density.

| Composition | $\theta_f$ (°C.) | $B_s$(T) | $\rho$(g/cm$^3$) | $\lambda(10^{-6})$ | $T_{x1}$(°C.) |
|---|---|---|---|---|---|
| $Fe_{73}Nb_3B_{20}Si_4$ | 320 | 1.25 | 7.37 | 17.4 | 586 |
| $Fe_{73}V_3B_{20}Si_4$ | 350 | 1.34 | — | 20.1 | 560 |
| $Fe_{78.5}W_{1.5}B_{17}Si_3$ | 345 | 1.39 | — | 22.0 | 521 |
| $Fe_{78.5}Zr_{1.5}B_{17}Si_3$ | 356 | 1.52 | 7.44 | 26.1 | 533 |
| $Fe_{78.5}Ti_{1.5}B_{17}Si_3$ | 355 | 1.42 | — | 29.3 | 524 |
| $Fe_{73}Ti_3B_{20}Si_4$ | 381 | 1.48 | — | 25.6 | 535 |
| $Fe_{78.5}Hf_{1.5}B_{17}Si_3$ | 355 | 1.37 | — | 24.8 | 543 |
| $Fe_{78.5}Ti_{1.5}B_{17}Si_3$ | 355 | 1.42 | — | 29.3 | 524 |
| $Fe_{73}Hf_3B_{20}Si_4$ | 354 | 1.28 | — | 19.3 | 587 |
| $Fe_{73}Ta_3B_{20}Si_4$ | 406 | 1.39 | — | 15.4 | 571 |

TABLE VIII

Examples of high frequency magnetic properties of Fe-M-B-Si alloys where M=Nb, V, W, Zr, Ti, Hf, or Ta. The alloys were annealed at temperature $T_a$ for a time $t_a$ without applied field and subsequently cooled at a rate of about −1° C./min. Exciting power ($P_e$), core loss (L), and permeability ($\mu$) were measured at a frequency of f=50 kHz and at a maximum induction level $B_m$=0.1 Tesla. $H_c$ is the dc coercivity.

TABLE VIII

| | $T_a$ (°C.) | $t_a$ (h) | $P_e$ (VA/kg) | L (w/kg) | $\mu$ | $H_c$(A/m) |
|---|---|---|---|---|---|---|
| $Fe_{73}Nb_3B_{20}Si_4$ | 420 | 2 | 24.0 | 11.6 | 7040 | 2.8 |
| $Fe_{73}V_3B_{20}Si_4$ | 420 | 2 | 22.0 | 11.4 | 7640 | 3.1 |
| $Fe_{78.5}W_{1.5}B_{17}Si_3$ | 420 | 2 | 30.3 | 11.2 | 5460 | 4.7 |
| $Fe_{78.5}Zr_{1.5}B_{17}Si_3$ | 420 | 2 | 26.1 | 12.2 | 6330 | 7.8 |
| $Fe_{78.5}Hf_{1.5}B_{17}Si_3$ | 420 | 2 | 18.6 | 10.9 | 9090 | 5.9 |
| $Fe_{78.5}Ti_{1.5}B_{17}Si_3$ | 420 | 2 | 26.0 | 12.3 | 6570 | 7.5 |
| $Fe_{73}Ta_3B_{20}Si_4$ | 420 | 2 | 37.2 | 12.9 | 4489 | 11.3 |

Example 3: Fe-M-B-Si-C System

Ribbons having compositions given by $Fe_{100-a-b-c-d}M_aB_bSi_cC_d$ where M=Cr or Mo and having dimensions about 1 cm wide and about 25 to 50 μm thick were formed as in Example 1. The metal "M" content was varied from 1 to 6 atom percent, and the carbon content "d" was 0 to 2 atom percent for which substantially glassy ribbons were obtained. The metal "M" content greater than about 6 atom percent reduced the Curie temperature to an unacceptably low value.

The magnetic and thermal data are summarized in Table IX below. The magnetic properties of these metallic glasses after annealing are presented in Table X. A combination of low ac core loss, high permeability, and high thermal stability of the metallic glasses of the present invention renders these composition suitable in the magnetic cores of transformers, recording heads and the like.

TABLE IX

Examples of basic physical and magnetic properties of Fe-M-B-Si-C amorphous alloys where M=Cr or Mo. $\theta_f$ and $T_{x1}$ are the ferromagnetic Curie and first crystallization temperatures, respectively. $B_s$ and $\lambda_s$ are the room temperature saturation induction and saturation magnetostriction, respectively. $\rho$ is the mass density.

TABLE IX

| Composition | | | | | | | | | | |
|---|---|---|---|---|---|---|---|---|---|---|
| Fe | Cr | Mo | B | Si | C | $\theta_f$(°C.) | $B_s$(t) | $\rho$(g/cm$^3$) | $\lambda_s(10^{-6})$ | $T_{x1}$(°C.) |
| 76 | 1.5 | 1.5 | 17 | 4 | — | 362 | 1.39 | 7.12 | 15.6 | 535 |
| 76 | 3 | — | 17 | 2 | 2 | 324 | 1.36 | — | 14.3 | 511 |
| 76 | — | 3 | 17 | 2 | 2 | 299 | 1.30 | — | 17.3 | 535 |
| 77 | 1.5 | — | 16 | 5 | 0.5 | 359 | 1.48 | — | 25.1 | 523 |

TABLE IX-continued

| Composition | | | | | | | | | | |
|---|---|---|---|---|---|---|---|---|---|---|
| Fe | Cr | Mo | B | Si | C | $\theta_f$(°C.) | $B_s$(t) | $\rho$(g/cm$^3$) | $\lambda_s$($10^{-6}$) | $T_{x1}$(°C.) |
| 78 | — | 2 | 13 | 6 | 1 | 324 | 1.36 | — | 24.4 | 525 |
| 78 | 2 | — | 13 | 6 | 1 | 339 | 1.40 | — | 21.4 | 514 |
| 78 | 2 | — | 12 | 7 | 1 | 331 | 1.37 | — | 26.3 | 521 |
| 78 | 2 | — | 13.5 | 5.5 | 1 | 341 | 1.41 | — | 22.7 | 509 |
| 78 | — | 2 | 12 | 7 | 1 | 336 | 1.35 | — | 22.6 | 516 |

TABLE X

Examples of high frequency magnetic properties of Fe-M-B-Si-C alloys where M=Mo or Cr. The alloys were annealed at temperature $T_a$ for a time $t_a$ without applied field and subsequently cooled at a rate of about −1° C./min. Exciting power ($P_e$), core loss (L), and permeability ($\mu$) were measured at a frequency of f=50 kHz and a maximum induction level $B_m$=0.1 Tesla. $H_c$ is the dc coercivity.

TABLE X

| Composition | | | | | | | | | | | |
|---|---|---|---|---|---|---|---|---|---|---|---|
| Fe | Cr | Mo | B | Si | C | $T_a$(°C.) | $t_a$(h) | $P_e$(VA/kg) | L(W/kg) | $\mu$ | $H_c$(A/m) |
| 76 | 1.5 | 1.5 | 17 | 4 | — | 435 | 2 | 36.0 | 15.3 | 4870 | 7.2 |
| 76 | 3 | — | 17 | 2 | 2 | 420 | 2 | 22.8 | 12.2 | 7500 | 5.3 |
| 76 | — | 3 | 17 | 2 | 2 | 420 | 2 | 22.5 | 10.7 | 7410 | 4.6 |
| 77 | 1.5 | — | 16 | 5 | 0.5 | 430 | 2 | 24.5 | 14.4 | 6819 | 5.3 |
| 78 | — | 2 | 13 | 6 | 1 | 430 | 2 | 23.2 | 11.8 | 7200 | 4.0 |
| 78 | 2 | — | 13 | 6 | 1 | 430 | 2 | 36.3 | 11.2 | 4600 | 9.8 |
| 78 | 2 | — | 12 | 7 | 1 | 430 | 2 | 25.7 | 12.4 | 6500 | 5.0 |
| 78 | 2 | — | 13.5 | 5.5 | 1 | 415 | 2 | 27.0 | 10.0 | 6200 | 7.4 |
| 78 | — | 2 | 12 | 7 | 1 | 420 | 2 | 29.8 | 9.1 | 5720 | 8.1 |

Having thus described the invention in rather full detail, it will be understood that this detail need not be strictly adhered to but that various changes and modifications may suggest themselves to one skilled in the art, all falling within the scope of the present invention as defined by the subjoined claims.

What is claimed is:

1. A metallic glass that is substantially completely glassy having a permeability of at least 5050, saturation magnetization of about 1.0–1.4T, magnetostriction ranging from 15–25×$10^{-6}$, coercivity less than about 8 A/m, ac core loss less than about 18.1 W/kg, exciting power less than about 33 VA/kg, thermal stability such that first crystallization temperature is at least about 500° C., and Curie temperature of at least about 250° C., said permeability, ac core loss and exciting power being measured at a frequency of 50 kHz and at a maximum induction of 0.1 Tesla, and having the general formula $Fe_aM_bM'_cB_dSi_eC_f$ in which "a"–"f" are in atom percent, the sum ("a"+"b"+"c"+"d"+"e"+"f") equals 100, M is at least one member selected from the group consisting of Ti, Zr, Hf, Nb, Ta and Mo, M' is at least one member selected from the group consisting of Cr, V and W, "a" ranges from about 66 to 81.5, "b" and "c" each range from 0 to 6, the sum ("b"+"c") ranges from about 0.5 to 6, "d" ranges from about 10 to 26, "e" ranges from about 1 to 12, "f" ranges from about 0 to 2 atom percent, the sum ("d"+"e"+"f") ranges from about 18 to 28, and "e"/("d"+"e"+"f") is less than about 0.4, with the following provisos:

(i) when "b" and "f" are zero and 4.5<"c"<6, then either "e"/("d"+"e") is less than about 0.20 or "e"/("d"+"e") ranges from 0.3 to 0.4;

(ii) when "b" and "f" are zero and 1.5<"c"<4.5, then either "e"/("d"+"e") is less than about 0.25 or "e"/("d"+"e") ranges from about 0.3 to 0.4;

(iii) when "b" and "f" are zero, 0.5<"c"<1.5, and ("d"+"e")<20, then "e"/("d"+"e")<0.25;

(iv) when "c" and "f" are zero, "b"<4, and "e"+"d"<21, then "e"/("d"+"e") is less than 0.35;

(v) when "c" and "f" are zero and "b"≧4, then "d"+"e" is greater than about 19 and either "e"/("d"+"e") is less than 0.25 "e"/("d"+"e") ranges from 0.3 to 0.4.

2. The metallic glass of claim 1 in which the permeability measured at an induction level of 0.1T and at a frequency of 50 kHz is at least than about 8000.

3. The metallic glass of claim 1 in which the ac core loss and exciting power, measured at an induction level of 0.1T and at a frequency of 50 kHz, are less than about 12 W/kg and 30 VA/kg, respectively.

4. The metallic glass of claim 1 wherein the permeability measured at an induction level of 0.1T and at a frequency of 50 kHz is at least about 10,500.

5. The metallic glass of claim 1 wherein the ac core loss is less than about 7 W/kg and the exciting power is less than about 16.5 VA/kg, each of said ac core loss and exciting power being measured at an induction level of 0.1T and at a frequency of 50 kHz.

6. The metallic glass of claim 1 wherein the coercivity is less than about 2.8 A/m.

7. The metallic glass of claim 1 in which the sum ("b"+"c") ranges from about 1 to 4, "d" ranges from about 12 to 24, "e" ranges from about 1 to 8, and "f" ranges from about 0 to 2.

8. The metallic glass of claim 7 in which M is Mo and M' is Cr.

9. The metallic glass of claim 8 in which "b" is zero.

10. The metallic glass of claim 8 in which "c" is zero.

11. The metallic glass of claim 8 in which "e" ranges from about 1 to 8 and the sum ("d"+"e"+"f") ranges from about 18 to 23.

12. The metallic glass of claim 1 in which the ferromagnetic Curie temperature is greater than about 300° C.

* * * * *